US010527343B2

(12) United States Patent
Met et al.

(10) Patent No.: US 10,527,343 B2
(45) Date of Patent: Jan. 7, 2020

(54) STORAGE CONTAINER SUITABLE TO BE USED IN A REFRIGERATOR

(71) Applicant: ARCELIK ANONIM SIRKETI, Istanbul (TR)

(72) Inventors: Aylin Met, Istanbul (TR); Cumhur Ayvazoglu, Istanbul (TR); Halime Esin Akin, Istanbul (TR)

(73) Assignee: ARCELIK ANONIM SIRKETI, Istanbul (TR)

( * ) Notice: Subject to any disclaimer, the term of this patent is extended or adjusted under 35 U.S.C. 154(b) by 217 days.

(21) Appl. No.: 15/546,631

(22) PCT Filed: Jan. 26, 2016

(86) PCT No.: PCT/EP2016/051520

§ 371 (c)(1),
(2) Date: Jul. 26, 2017

(87) PCT Pub. No.: WO2016/120243

PCT Pub. Date: Aug. 4, 2016

(65) Prior Publication Data

US 2018/0017316 A1 Jan. 18, 2018

(30) Foreign Application Priority Data

Jan. 26, 2015 (TR) ..... 2015/00847

(51) Int. Cl.
*F25D 25/02* (2006.01)
*F25D 17/04* (2006.01)

(52) U.S. Cl.
CPC ..... *F25D 25/028* (2013.01); *F25D 17/042* (2013.01); *F25D 25/024* (2013.01)

(58) Field of Classification Search
CPC ..... F25D 25/028; F25D 17/042; F25D 2317/061; F25D 25/024
See application file for complete search history.

(56) References Cited

U.S. PATENT DOCUMENTS

| | | | | |
|---|---|---|---|---|
| 5,303,563 | A | 4/1994 | Bishop et al. | |
| 2007/0271948 | A1* | 11/2007 | Grobleben | F25D 25/005 62/382 |
| 2008/0236038 | A1 | 10/2008 | Pierce et al. | |
| 2010/0221393 | A1 | 9/2010 | Lim et al. | |

FOREIGN PATENT DOCUMENTS

| | | | |
|---|---|---|---|
| EP | 0248370 | A2 | 12/1987 |
| EP | 0248370 | B1 | 7/1991 |
| JP | 2000180017 | A | 6/2000 |
| KR | 2010065500 | A | 6/2010 |

OTHER PUBLICATIONS

International search report and written opinion, dated Mar. 22, 2016, of International Application No. PCT/EP2016/051520; 8 pgs.

* cited by examiner

*Primary Examiner* — Brian M King
(74) *Attorney, Agent, or Firm* — Kilpatrick Townsend & Stockton LLP

(57) ABSTRACT

The present invention relates to a refrigerator comprising a storage container that has a crisper wherein the fruits and/or the vegetables are stored and a body that supports the crisper and that facilitates the placement of the crisper into the refrigerator.

8 Claims, 6 Drawing Sheets

STORAGE CONTAINER SUITABLE TO BE USED IN A REFRIGERATOR

RELATED APPLICATIONS

Figure 1:
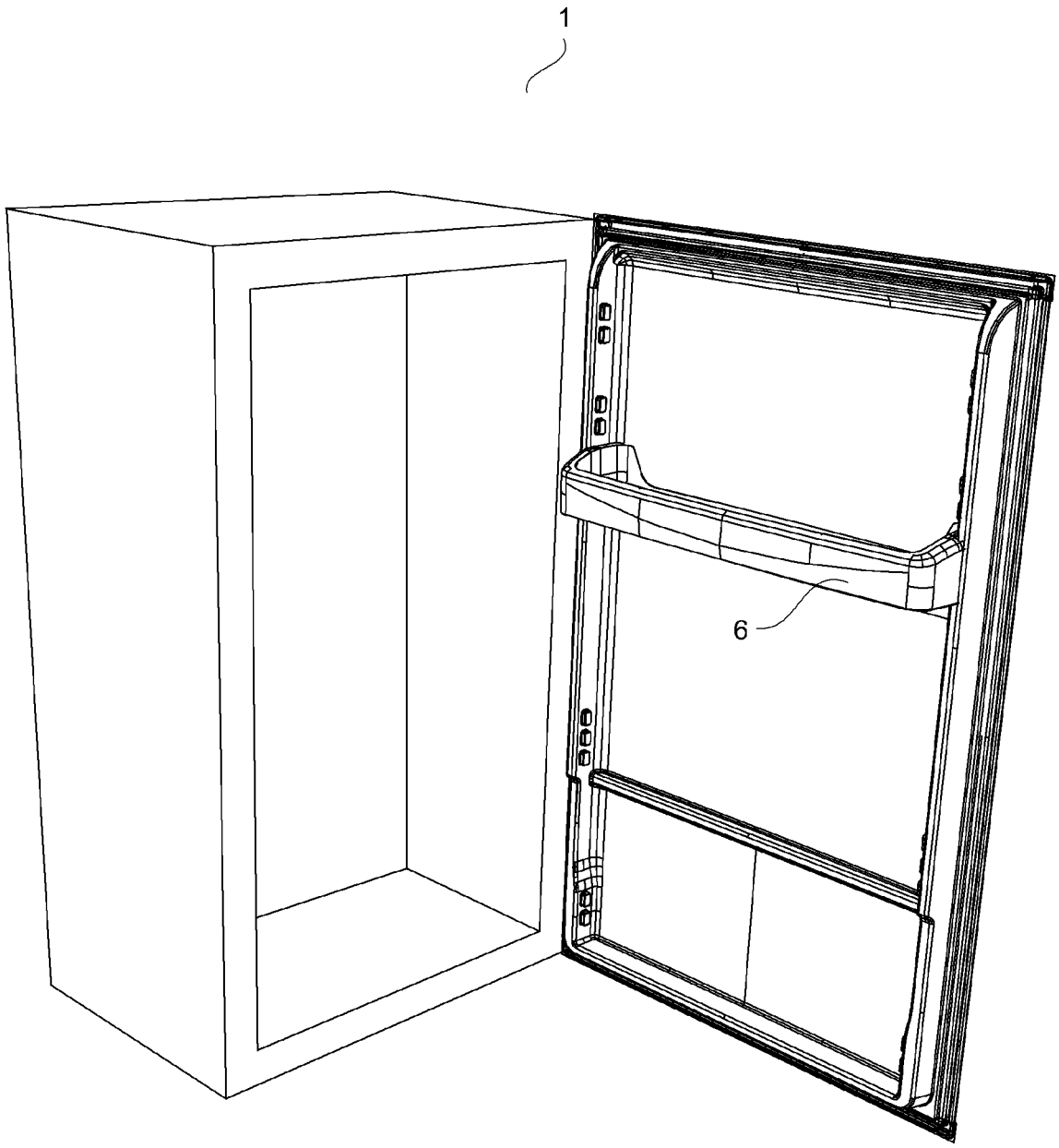

This application is a U.S. National Phase of International Application No. PCT/EP2016/051520, filed Jan. 26, 2016, claiming priority to Turkish Patent Application No. 2015/00847, filed Jan. 26, 2015, contents of which are hereby incorporated by reference in their entirety.

The present invention relates to a storage container suitable to be used in a refrigerator.

Fruits and vegetables stored in a refrigerator are expected to remain fresh for a long time. However, aerobic organisms growing due to the oxygen and the moisture in the environment change the color, taste and odor of the foodstuffs, thus causing them to spoil. In particular, the fact that the decay rate of fresh green leafy vegetables with high respiration rates is high affects other vegetables and fruits stored with these leafy vegetables and deteriorates the storage conditions. In the state of the art, the use of storage containers suitable to be used in refrigerators and comprising semipermeable membranes is known for the fruits and vegetables to remain fresh for a long time. However, that the membranes get dirty and the pores thereof are clogged in the course of time cause the storage time to shorten.

In the state of the art European Patent No EP0248370, a refrigerator comprising a vegetable storing container wherein a film of gas permeability is used is disclosed.

The aim of the present invention is the realization of a refrigerator comprising a storage container with facilitated utilization.

The refrigerator realized in order to attain the aim of the present invention, explicated in the first claim and the respective claims thereof comprises a crisper wherein fruits and vegetables are stored and a body whereon the crisper is mounted. The refrigerator furthermore comprises a housing that is disposed on the body and a filter that is placed into the housing, that can be replaced with a new one after being removed from inside the housing by the user and that has a gas permeability value optimized so that the ideal gas composition required for the fruits and vegetables in the storage container to remain fresh for a long time is obtained.

In an embodiment of the present invention, the filter is preferably produced as a roll composed of disposable segments, thus the filter can be easily replaced when desired.

In an embodiment of the present invention, the filter is placed over the storage container so as to be under the body when the crisper is in the closed position and placed over the crisper after being removed from under the body when the crisper is tilted forward to be changed to the open position. Thus, the filter is stored on the body when the storage container is not used and can be easily removed and used by benefiting from the gap between the body and the crisper after the crisper is tilted when the storage container is desired to be used.

In an embodiment of the present invention, the refrigerator comprises a plurality of protrusions that are disposed oppositely on the crisper and that enable the crisper to be mounted to the body so as to be tilted forwards and opened when pulled.

In an embodiment of the present invention, the refrigerator comprises a cassette that is placed into the housing when the crisper is in the closed position and over the crisper when the crisper is the open position and that serves for the filter as a housing wherein the filter is placed. By means of the cassette, the filter is enabled to remain clean for a longer time.

In an embodiment of the present invention, the filter is pulled over the crisper when the crisper is in the open position so as to physically isolate the crisper from the outer environment. Thus, convenience of utilization is provided by using the filter as a cover.

In an embodiment of the present invention, the refrigerator comprises a plurality of openings that are disposed on the body and that enable the entry of air into the crisper when the crisper is in the closed position. Since air intake into the crisper is provided by means of the openings, formation of odor in the crisper is prevented.

In an embodiment of the present invention, the refrigerator comprises a gasket that is mounted to the upper edges of the crisper. The gasket remains between the cassette and the storage container when the cassette is closed over the crisper. Thus, by means of the vacuum effect created in the crisper, the fruits and the vegetables are enabled to remain fresh for a longer time.

The refrigerator realized in order to attain the aim of the present invention is illustrated in the attached figures, where:

FIG. 1—is the perspective view of the refrigerator.

Figure 2:
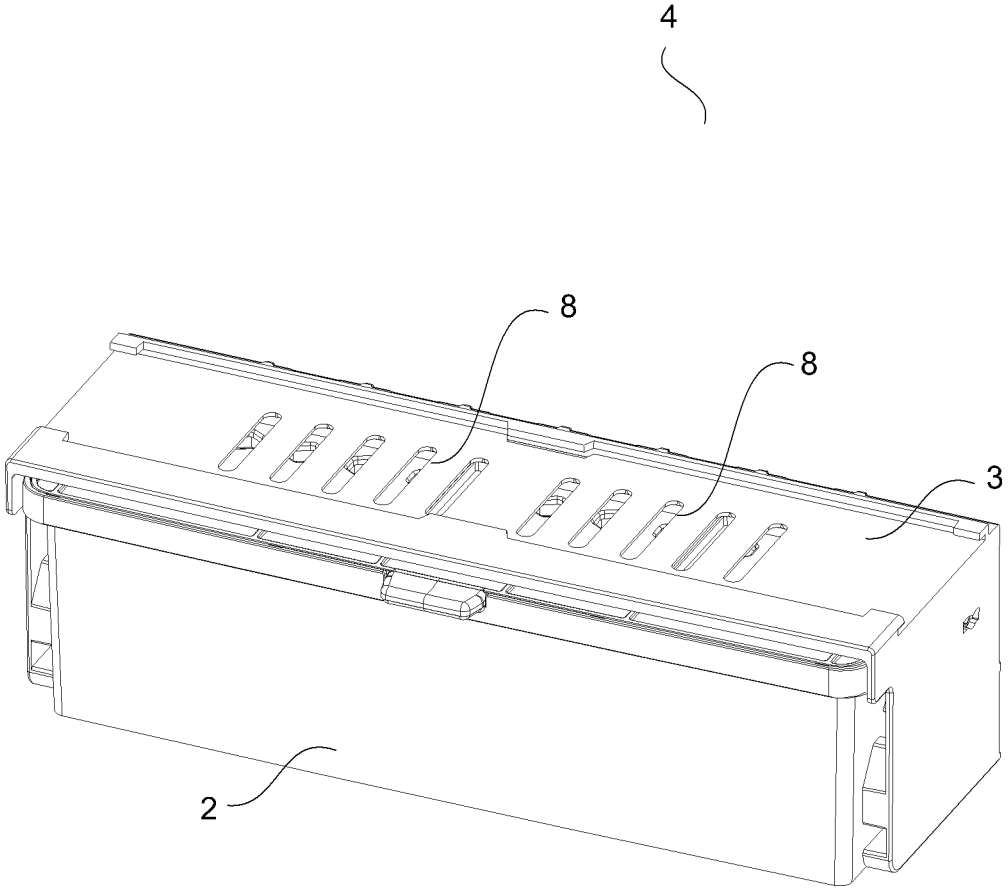

FIG. 2—is the perspective view of the storage container.

Figure 3:
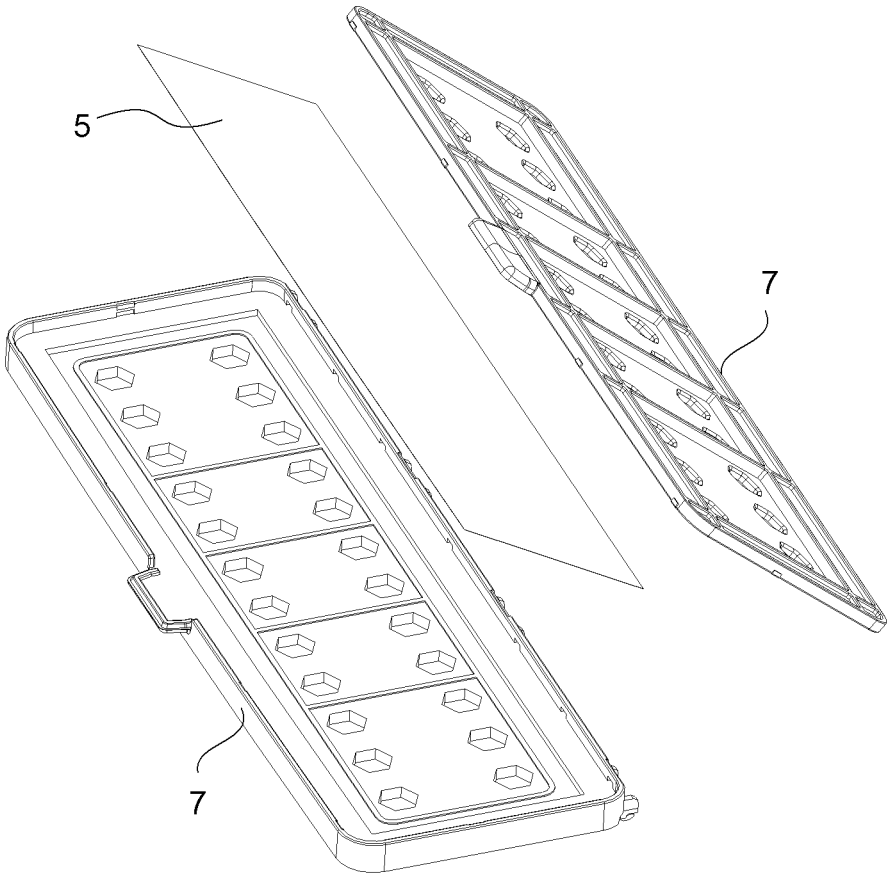

FIG. 3—is the perspective view of the cassette and the filter.

Figure 4:
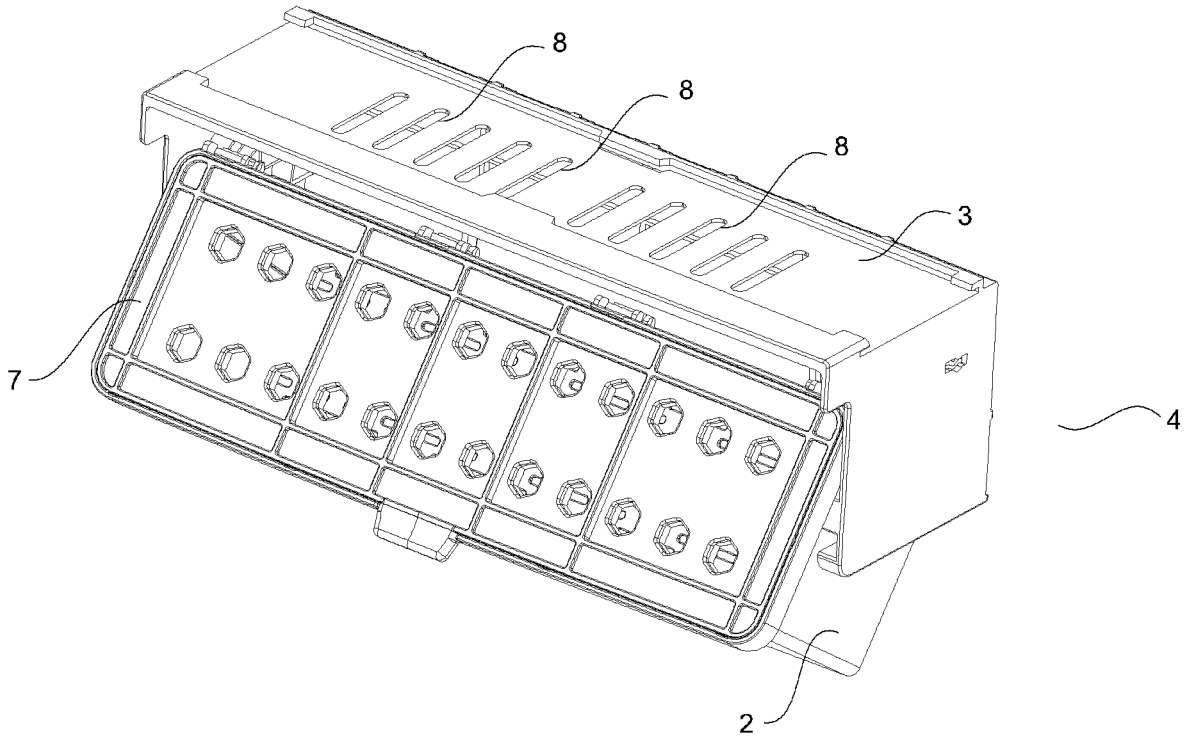

FIG. 4—is the perspective view of the storage container and the cassette.

Figure 5:
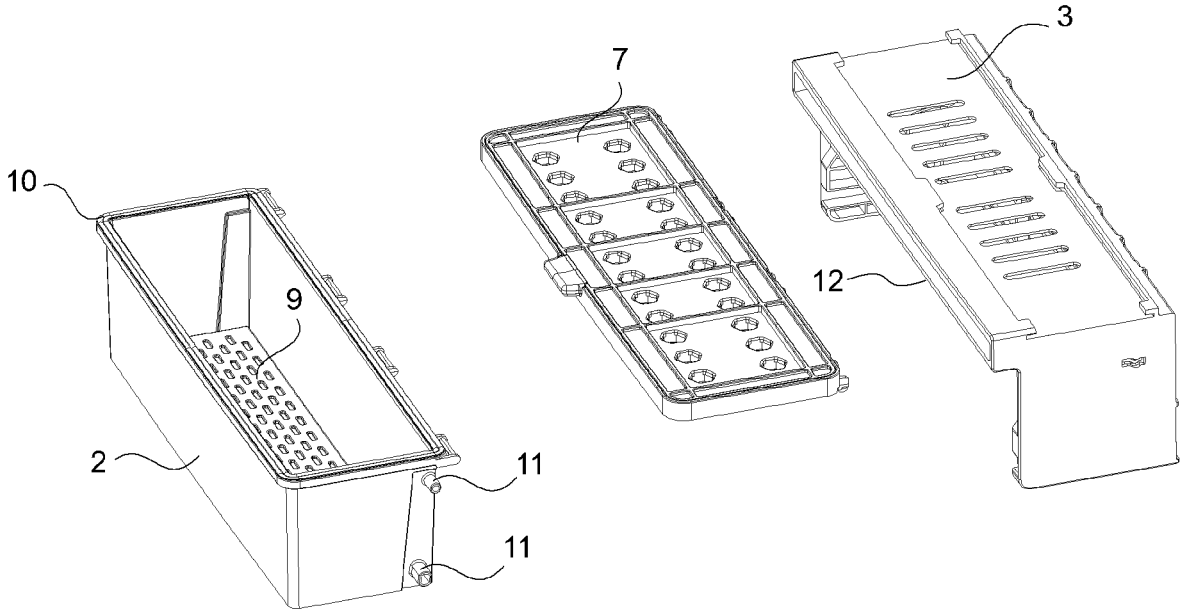

FIG. 5—is the perspective view of the crisper, the cassette and the body.

Figure 6:
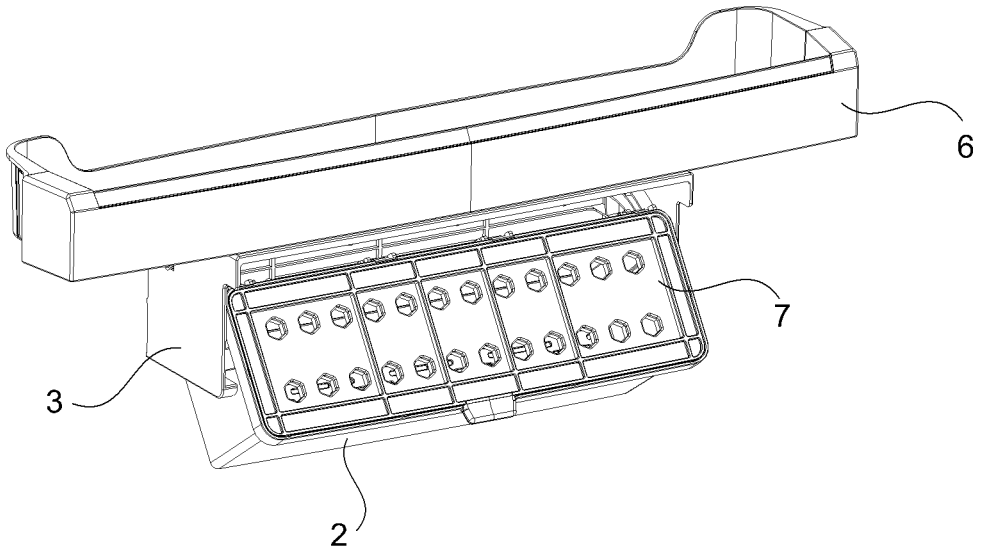

FIG. 6—is the perspective view of the storage container when the crisper is in the open position.

The elements illustrated in the figures are numbered as follows:

1. Refrigerator
2. Crisper
3. Body
4. Storage container
5. Filter
6. Door shelf
7. Cassette
8. Opening
9. Plate
10. Gasket
11. Protrusion
12. Housing The refrigerator (1) comprises a storage container (4) that has a crisper (2) wherein the fruits and/or the vegetables are stored and a body (3) that supports the crisper (2) and wherein the crisper (2) is placed.

The refrigerator (1) of the present invention comprises a housing (12) that is disposed on the body (3) so as to remain above the crisper (2) and a semipermeable filter (5) that is detachably disposed into the housing (12) and that enables the foodstuffs to remain fresh. The filter (5) has a porous configuration so as to enable the passage of gases in certain concentrations. By means of the filter (5) that is detachably mounted to the storage container (4), the filter (5) can be replaced with a new one even if the pores are clogged with humidity and dirt in the course of time. Thus, the fruits and the vegetables stored in the storage container (2) are always kept fresh.

In an embodiment of the present invention, the crisper (2) has a closed position wherein the crisper (2) is almost completely seated into the body (3) and an open position to which the crisper (2) is changed from the closed position by being tilted forward and wherein the interior thereof can be accessed. The filter (5) is placed into the housing (12) when the crisper (2) is in the closed position and placed over the crisper (2) by being removed from inside the housing (12) and slid when the crisper (2) is in the open position. Thus, the filter (5) can be easily pulled from inside the housing (12) and placed over the crisper (2) when desired to be used. Moreover, by means of the housing (12) arranged on the body (3), a separate space for storing the filter (5) is not needed and the filter (5) is prevented from getting lost.

In an embodiment of the present invention, the refrigerator (1) comprises a plurality of protrusions (11) that are disposed oppositely on the crisper (2) and that enable the crisper (2) to be mounted to the body (3) and to be switched between the closed and open positions. The protrusions (11) enable the crisper (2) to be tilted forwards so as to be opened.

In an embodiment of the present invention, the refrigerator (1) comprises a portable cassette (7) that can be easily opened/closed, that can be placed into the housing (12) or over the crisper (2) and that enables the placement of the filter (5) therein. The cassette (7) surrounds the filter (5), thus providing a more rigid structure and enabling the filter (5) to be more easily mounted/dismounted. Moreover, by means of the cassette (7), the filter (5) is enabled to remain clean for a longer time.

In an embodiment of the present invention, the filter (5) serves as a cover by covering over the crisper (2) when the crisper (2) is in the open position. Thus, convenience of utilization is provided by using the filter (5) for multiple purposes. By means of the filter (5) that also serves as a cover, there remains no need to produce a separate cover, thus decreasing production costs.

In an embodiment of the present invention, the refrigerator (1) comprises a plurality of openings (8) that are disposed on the body (3) and that enable the entry of air into the crisper (2) when the crisper (2) is in the closed position. Thus, by providing the discharge of the moisture in the crisper (2), formation of odor in the crisper (2) is prevented.

In an embodiment of the present invention, the refrigerator (1) comprises a plate (9) that is disposed into the crisper (2) so that a gap remains between the plate (9) and the crisper (2) base and that enables the fruits and the vegetables to be placed thereon. By means of the plate (9), water droplets on the humid fruits and vegetables run down under the plate (9), thus enabling the fruits and the vegetables to be stored for a longer time.

In an embodiment of the present invention, the refrigerator (1) comprises a gasket (10) that is disposed on the crisper (2) and that prevents the air entry into the crisper (2) by squeezing between the crisper (2) and the cassette (7) as a result of the pressure applied thereon by the cassette (7) when the cassette (7) is placed onto the crisper (2).

In an embodiment of the present invention, the refrigerator (1) comprises at least one door shelf (6) disposed thereon and the storage container (4) is disposed under the door shelf (6). The body (3), that is used as a hanger, facilitates the attachment of the storage container (4) to the door shelf (6).

By means of the present invention, in particular by means of the filter that is detachably mounted to the storage container (4), the filter (5) can be replaced with a new one when deformed. Thus, the fruits and the vegetables stored in the storage container (2) are always kept fresh. The use of the storage container (4) is facilitated by means of the compact structure that is composed of only the crisper (2) and the body (3). Since the filter (5) can be concealed in the storage container (4) when the storage container (4) is not used, user satisfaction is improved.

The invention claimed is:

1. A refrigerator comprising:

a storage container that has a crisper wherein foodstuffs are stored and a body that supports the crisper and wherein the crisper is placed, a housing that is disposed on the body so as to remain above the crisper, and a semipermeable filter that is detachably disposed into the housing and that enables the foodstuffs to remain fresh, wherein the crisper has a closed position and an open position to which the crisper is changed from the closed position by being tilted forward, the crisper is seated into the body in the closed position, an interior of the crisper is accessed in the open position, and wherein the filter is placed into the housing when the crisper is in the closed position and placed over the crisper by being removed from inside the housing when the crisper is changed to the open position.

2. The refrigerator as in claim 1, further comprising:

a plurality of protrusions that are disposed oppositely on the crisper and that enable the crisper to be mounted to the body and to be switched between the closed position and the open position.

3. The refrigerator as claim 1, further comprising:

a portable cassette configured to be opened/closed, and be placed into the housing or over the crisper, wherein the portable cassette enables placement of the filter therein.

4. The refrigerator as claim 1, wherein the filter serves as a cover by covering over the crisper when the crisper is in the open position.

5. The refrigerator as claim 1, further comprising:

a plurality of openings that are disposed on the body and that enable entry of air into the crisper when the crisper is in the closed position.

6. The refrigerator as claim 1, further comprising:

a plate that is disposed into the crisper so that a gap remains between the plate and a crisper base and that enables the foodstuffs to be placed thereon.

7. The refrigerator as claim 1, further comprising:

a gasket that is disposed on the crisper and that prevents air entry into the crisper by squeezing between the crisper and a cassette as a result of a pressure applied thereon by the cassette when the cassette is placed onto the crisper.

8. The refrigerator as claim 1, further comprising:

at least one door shelf, wherein the storage container is configured to be placed onto the door shelf.

* * * * *